US008800439B2

(12) United States Patent
Clark et al.

(10) Patent No.: US 8,800,439 B2
(45) Date of Patent: Aug. 12, 2014

(54) CONTINUOUSLY UPDATABLE ROTARY PAD PRINTING APPARATUS AND METHOD

(76) Inventors: Lloyd Douglas Clark, San Francisco, CA (US); Brian A. Brown, San Francisco, CA (US)

( * ) Notice: Subject to any disclaimer, the term of this patent is extended or adjusted under 35 U.S.C. 154(b) by 517 days.

(21) Appl. No.: 11/777,166

(22) Filed: Jul. 12, 2007

(65) Prior Publication Data

US 2008/0041250 A1 Feb. 21, 2008

Related U.S. Application Data

(60) Provisional application No. 60/822,534, filed on Aug. 16, 2006.

(51) Int. Cl.

| | |
|---|---|
| ***B41J 17/00*** | (2006.01) |
| ***B41J 2/01*** | (2006.01) |
| ***B41F 17/00*** | (2006.01) |
| ***B41J 2/005*** | (2006.01) |

(52) U.S. Cl.

CPC ..... *B41F 17/001* (2013.01); *B41J 2/0057* (2013.01)

USPC ..... 101/41; 101/194; 101/287; 101/492; 347/103

(58) Field of Classification Search

CPC ..... B41F 17/001; B41F 17/00; B41F 16/00; B41F 1/00; B41F 1/16; B41J 2/0057; B41J 3/543; B41J 3/4073; B41J 2/01

USPC ..... 101/41, 40, 35, 42, 93, 193, 194, 195, 101/200, 287, 297, 492; 347/103

See application file for complete search history.

(56) References Cited

U.S. PATENT DOCUMENTS 4,723,485 A * 2/1988 Berberich et al. ..... 101/44
5,471,233 A 11/1995 Okamoto et al.

(Continued)

FOREIGN PATENT DOCUMENTS

DE 3820340 C1 6/1988
DE 4020223 C1 6/1990

OTHER PUBLICATIONS

U.S. Appl. No. 60/792,254, filed Apr. 14, 2006, L.D. Clark et al.

(Continued)

*Primary Examiner* — Daniel J Colilla
*Assistant Examiner* — Blake A Tankersley

(57) ABSTRACT

A rotary pad printing system comprises a compressible pad wheel (105), one or more inkjet or other image applicator heads (400), optional treatment stations (500), a shaft encoder (535), a control unit (540), and an image source (565). The image applicator heads apply an image to the wheel and the treatment stations can supply treatments such as heat, gas, light, overcoats, and undercoats. The image is then transferred to a receiving surface (532). An optional cleaning station (510) cleans the rotary pad prior to application of the next or a continuous image. Each image can be different and can be applied to a moving surface. Since the rotary pad can continuously receive updated image information, the area printed can range from a single pixel to an image of indefinite length. In an alternative embodiment, a domed pad is used. In another alternative embodiment, a flexible belt (1000) is used instead of a rotary wheel. In another alternative embodiment, a segmented pad (2205) is used.

25 Claims, 8 Drawing Sheets

(56) References Cited

U.S. PATENT DOCUMENTS

| | | | | |
|---|---|---|---|---|
| 5,799,576 | A * | 9/1998 | Koike et al. | 101/111 |
| 5,801,729 | A | 9/1998 | Kitamura et al. | |
| 6,135,654 | A * | 10/2000 | Jennel | 400/61 |
| 6,276,266 | B1 * | 8/2001 | Dietz et al. | 101/41 |
| 6,840,167 | B2 * | 1/2005 | Clark et al. | 101/41 |
| 2003/0136281 | A1 | 7/2003 | Clark et al. | |
| 2004/0062592 | A1 * | 4/2004 | Shekalim et al. | 401/208 |
| 2004/0099159 | A1 * | 5/2004 | Volder | 101/35 |
| 2006/0213379 | A1 * | 9/2006 | Uptergrove | 101/35 |
| 2007/0144364 | A1 * | 6/2007 | Hitchcock | 101/41 |

OTHER PUBLICATIONS

U.S. Appl. No. 11/464,203, filed Aug. 13, 2006, L.D. Clark et al.

U.S. Appl. No. 11/558,911, filed Nov. 11, 2006, L.D. Clark et. al.

Author Unknown, "New PadJet™ Digital Pad Printing System", Graphics Pro Magazine, Sep.-Oct. 2004.

* cited by examiner

CONTINUOUSLY UPDATABLE ROTARY PAD PRINTING APPARATUS AND METHOD

CROSS-REFERENCE TO RELATED APPLICATIONS

This application claims priority of our provisional patent application, Ser. No. 60/822,534, filed Aug. 16, 2006. This application is related to and incorporates for reference purposes our U.S. Pat. No. 6,840,167 and our pending U.S. patent application Ser. No. 11,464,203, filed Aug. 13, 2006, Ser. No. 11/558,911, filed Nov. 11, 2006, and Ser. No. 11/697,171, filed Apr. 5, 2007.

BACKGROUND

1. Field

The field is pad printing, and in particular rotary transfer pad printing.

2. Prior Art—FIGS. 1 through 3

FIGS. 1 and 2 show a prior-art rotary pad printing system. FIG. 3 shows an elliptically-shaped object printed on such a system.

In the past, rotary pad printing has been used to decorate objects by printing images or text thereon. In its simplest form, a rotary pad printing apparatus comprises a rotary cliche ink-image donor roll 100 (FIG. 1), a compressible rubber transfer pad in the form of a wheel 105 typically formed around a steel shaft 106, and an ink source 110. An object to be decorated 115 is arranged to move in contact with wheel 105.

An image is first etched into rotary cliche 100, in well-known fashion. In this case, the numbers 1 through 5 are etched in cliche 100 to a depth of approximately 0.03 mm. Although numbers are shown here, the image can comprise text, graphics, and even photographic information.

Next, cliché 100 is placed into the printing apparatus, as shown in FIGS. 1 and 2. Ink supply 110 is filled with ink prior to printing. When printing commences, cliche 100 and wheel 105 are driven to rotate against one-another by a mechanism (not shown). Directions of motion are indicated by arrows. As cliché 100 turns, ink from source 110 is doctored into the etched surface of cliché 100 by ink source 110, in well-known fashion.

As cliché 100 turns against wheel 105 (FIG. 2), image-wise regions of ink 120 are transferred in near-entirety from cliché 100 to wheel 105. As rotation of cliché 100 and wheel 105 continues, ink regions 120 on wheel 105 are brought into contact with object 115. Object 115 is moved linearly as wheel 105 rotates. There is no slippage between the surfaces of object 115 and wheel 105. As ink regions 120 come into contact with object 115, they leave wheel 105 and most of ink in regions 120 transfers to object 115. Thus the image originally present on cliché 100 is transferred to object 115. Instead of using a flat object 115 and moving it linearly, an object with round or ellipsoid cross-section can be rotated against wheel 105 with axes of the object and the wheel parallel. This type of transfer motion is shown below.

Single-color images are transferred in the manner described above. If the user wishes to transfer multi-color images, color separations are required and a separate cliché is required for each color. Making a separate cliché for each color is expensive and time-consuming. Mounting and aligning separate cliché is also time-consuming. The objects to be decorated must be carefully aligned for subsequent passages through the rotary transfer pad printing apparatus. In general, this prior-art arrangement is suitable only for single-color transfers.

Since the image on the cliché is etched, each cliché contains only one image. Changing the image requires etching a new cliché and exchanging the new cliché for the old one. Thus it is impractical to use the prior-art apparatus to print small runs.

Furthermore, since the cliché transfers the etched and inked image to the rotary pad, the length of the image that can be transferred is limited by the circumference of the cliché.

SUMMARY

In accordance with one aspect of a first embodiment, a rotary pad printing apparatus is provided that can print constantly changing images of indefinite length in a plurality of colors. One or more print heads apply an ink image to the rotary pad, the pad transfers the image to a receiving surface, the pad is cleaned if necessary, and a new ink image is applied, ready for a subsequent transfer. In addition, the ink images can be underlaid or overlaid by surface treatments such as varnish, sealers, and other colors. The treatments can be applied using a spray, additional inkjet heads, or a brush, roller, or doctor blade. Substances applied to the rotary pad can be treated, before or after the ink image is applied to the receiving surface, by various methods including, but not limited to radiative processes, vapors, ionizing processes, plasma discharges, and the like.

In accordance with another aspect of the first embodiment, a rotary pad comprises a series of segments that have either fixed or variable shapes.

In accordance with one aspect of a second embodiment, a belt pad printing apparatus is provided. Images, coatings, and treatments are applied to and released from a belt instead of a wheel.

DRAWING FIGURES

DRAWING FIGURE REFERENCE NUMERALS

| | |
|---|---|
| 100 | Cliché |
| 105 | Wheel |

-continued

| | |
|---|---|
| 106 | Shaft |
| 110 | Ink Source |
| 115 | Object |
| 120 | Ink Region |
| 400 | Station |
| 401 | Source |
| 500 | Station |
| 501 | Source |
| 502 | Source |
| 505 | Station |
| 510-530 | Stations |
| 532 | Object |
| 535 | Encoder |
| 540 | Control Unit |
| 545 | Indicia |
| 550 | Indicia |
| 555 | Detector |
| 560 | Detector |
| 565 | Image Source |
| 570 | Pixel |
| 572 | Pixel |
| 574 | Overcoat |
| 576 | Pixel |
| 578 | Overcoat |
| 580 | Pixel |
| 582 | Overcoat |
| 584 | Undercoat |
| 700 | Arrow |
| 805 | Arrow |
| 900 | Surface |
| 905 | Inking assembly |
| 910 | Head |
| 915 | Arm |
| 920 | Pivot |
| 925 | Servomechanism |
| 930 | Clevis |
| 940 | Arrow |
| 1000 | Belt |
| 1001 | Wheel |
| 1002 | Wheel |
| 1005 | Object |
| 1010 | Ram |
| 1015 | Arrow |
| 1050 | Roller |
| 1100 | Roller |
| 1105 | Roller |
| 1600 | Source |
| 1601 | Emission |
| 1602 | Emission |
| 1605 | Reflector |
| 1610 | Surface |
| 1615 | Arrow |
| 1700 | Tip |
| 1705 | Gas |
| 1710 | Flame |
| 1715 | Surface |
| 1720 | Arrow |
| 1800 | Nozzle |
| 1805 | Material |
| 1810 | Surface |
| 1900 | Applicator |
| 1902 | Bristles |
| 1905 | Substance |
| 1910 | Surface |
| 1915 | Arrow |
| 2000 | Blade assembly |
| 2001 | Clamp |
| 2002 | Blade |
| 2005 | Material |
| 2010 | Object |
| 2015 | Arrow |
| 2100 | Roller |
| 2105 | Material |
| 2110 | Surface |
| 2115 | Arrow |
| 2200 | Rotor |
| 2201 | Shaft |
| 2205 | Pad |
| 2210 | Conveyor |

-continued

| | |
|---|---|
| 2215 | Object |
| 2300 | Bracket |
| 2600 | Motive source |
| 2605 | Actuator |

DESCRIPTION

Figure 1:
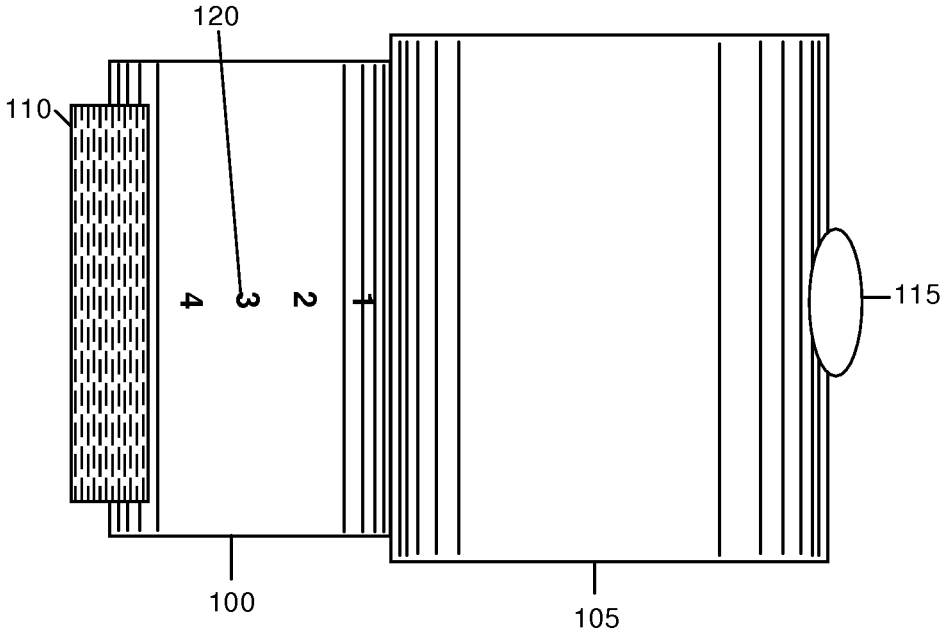
Fig. 1 Prior Art
FIGS. 1-3 show a prior-art rotary pad printing system.
Figure 2:
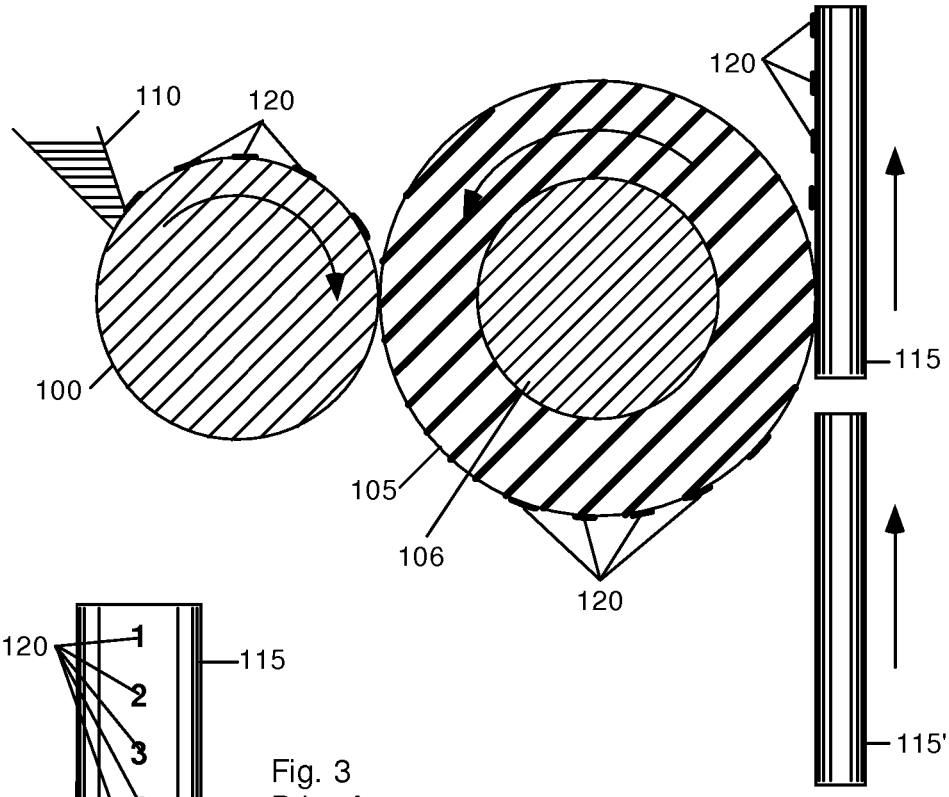
Fig. 2 Prior Art
Figure 3:
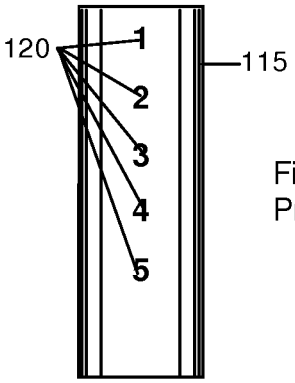
Fig. 3 Prior Art
Figure 4:
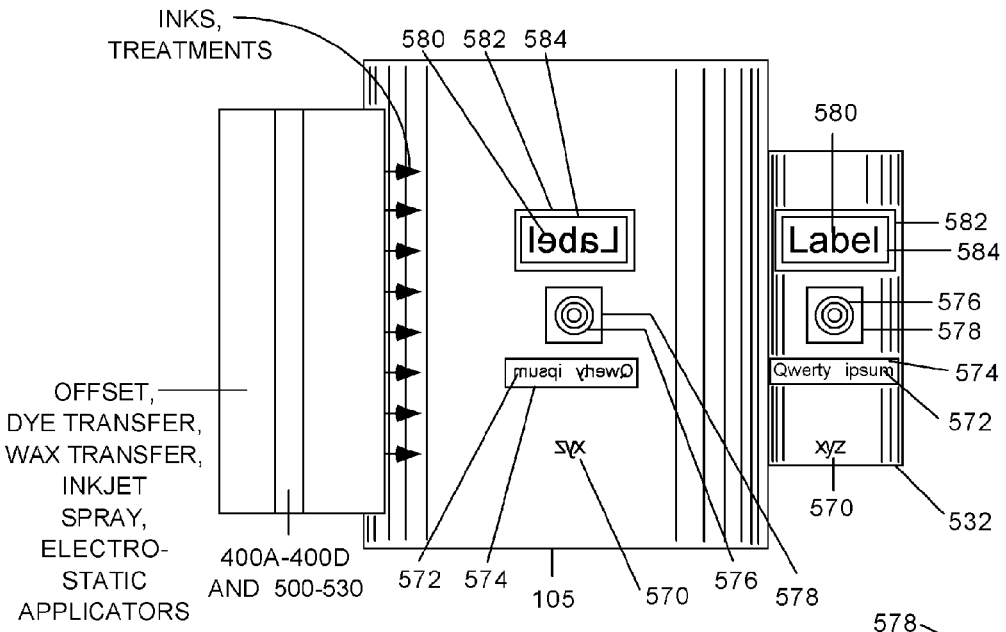
FIGS. 4 and 5 show plan and schematic cross-sectional side views respectively of one embodiment of a rotary pad printing system using inkjets to apply an image to the pad.
Figure 5:
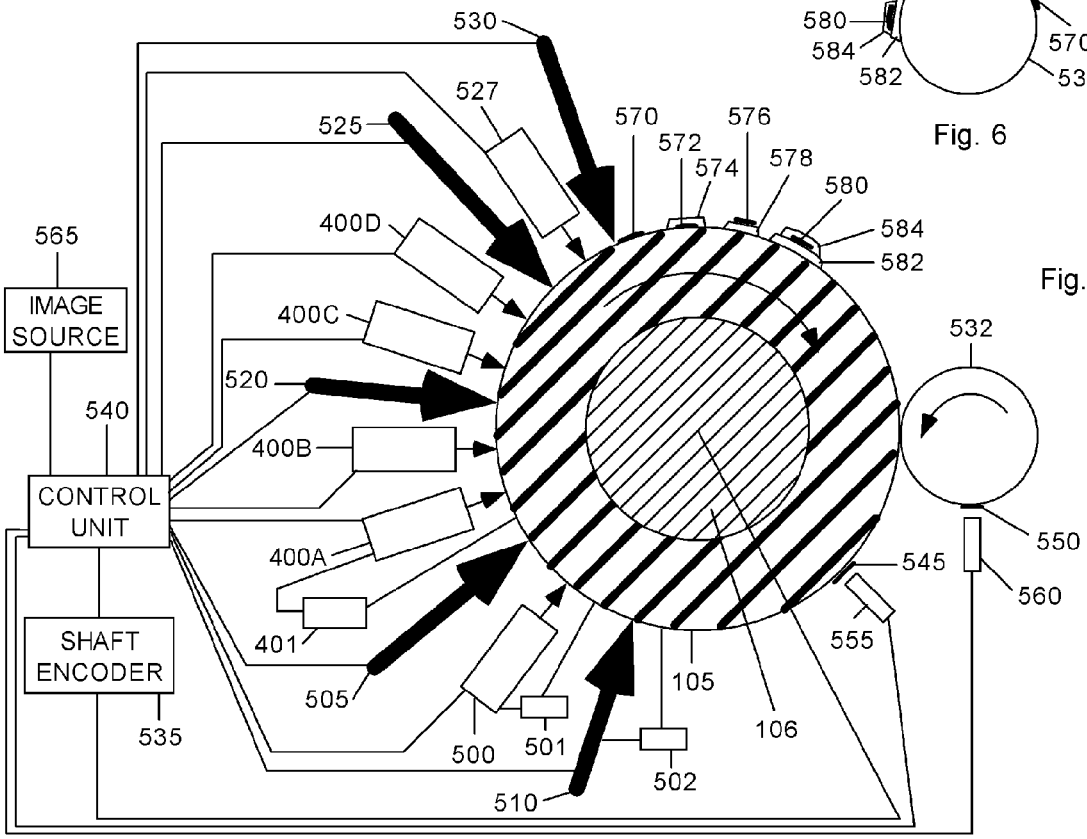

First Embodiment—FIGS. 4 and 5

FIGS. 4 and 5 show plan and schematic cross-sectional side views of one aspect of an embodiment of an improved rotary pad printing system. This system comprises one or more ink applicator head stations 400, a compressible rotary pad wheel 105 formed around an axial metal shaft 106, a first optional auxiliary applicator head 500 for applying a first substance to pad 105, a second optional auxiliary applicator head 505 for applying a second substance to pad 105, and a series of optional treatment stations 510-530, indicated by bold arrows. The surface of pad 105 is preferably smooth and continuous, although other textured surfaces such as matte, grained, striated, and the like can be used. Stations 510-530 can include spray heads for spraying liquid or powdered substances or vapors onto the surface of pad 105, applicators of radiant energy such as sonic energy, heat, light including ultraviolet light, x-rays, gamma rays, magnetic fields, electrostatic fields, plasma discharges, and the like. As can be judged by their placement, stations 510-530 can affect the material deposited on, or about to be deposited on, pad 105 in a variety of ways. Preferably station 510 is a cleaning station that cleans pad 105 after each image is transferred to object 532. Image residue on pad 105 can be removed by contact with blotting paper, adhesive tape, solvent rinse, and the like. At least one of stations 505 and 520-530 is preferably an ultraviolet or infrared source for treating substances applied by applicator head 500.

Ink applicator head stations 400 are inkjet printers but can be electrostatic, offset, dye-transfer, wax-transfer, spray, or any other kind of printer capable of applying ink or other substances such as varnishes, shellacs, UV-curing coatings, and the like to a surface. The inks dispensed by station 400 can be frit, particle, metallic, magnetic, dye, or pigment-containing, and can be water-based, multi-component, solvent-based, oil-based, wax-based, ultra-violet curable, infrared-curable, light-curable, heat-curable, cold-curable, catalyst-curable, microwave-curable, and evaporating inks.

Pad 105 typically comprises a silicone rubber of hardness between 5 and 85 durometer (Shore) units. Another elastomer such as gelatin, caoutchouc, latex rubber, synthetic rubber, plastic, or the like with suitable pad-printing properties can be used, if desired. The diameter of pad 105 is typically 15 cm, although smaller or larger diameters are usable. The length of pad 105 is typically 10 cm, although larger and smaller lengths can be used. The length of pad 105 is generally longer than the width of the image to be printed. Pad 105 is arranged to turn against an object to be printed, in this case a bottle or other cylindrical or semi-cylindrical object 532. A mechanism (not shown) supports cylinder 532 as it rotates against pad 105.

Pad 105 preferably is electrically insulating, but can be electrically conductive. If pad 105 is electrically conductive, it preferably is connected to a source of electrical potential 401 (FIG. 5) which in turn is connected to one or more of stations 400. Connection preferably is made to the surface of pad 105, but can be to shaft 106. Source 401 creates an electrical field between station 400 and pad 105 that attracts and guides droplets emitted by source 400 on their path toward pad 105. Similarly, stations 500, 505, 510, 520, 525, and 530 can be connected to electrical sources 501, 502, etc. to modify and improve their application of treatments and substances to the surface of pad 105, or to substances deposited thereon. The electrical output of sources 401, 501, and 502 preferably are direct current of either polarity, but can be alternating current, or a combination of the two, and preferably are steady but can be time-varying in both amplitude and frequency.

The length of shaft 106 is longer than the length of pad 105 in order for shaft 106 to be gripped and rotated by activating machinery. Preferably both ends of shaft 106 are gripped or supported by the activating machinery, but if shaft 106 is short (e.g., less than about 15 cm) it can be supported or gripped at one end only.

This aspect of the embodiment further includes a shaft encoder 535, and a control unit 540. Control unit 540 is a computing device such as a microprocessor or microcomputer that sends and receives electronic signals to and from external sources and loads. Encoder 535 is coupled to shaft 106 within pad 105. Encoder 535 reports the angular position of pad 105 to control unit 540. In response, unit 540 can initiate, sustain, and terminate printing and treatments via stations 400 and 500.

An image source 565 contains image information required in the printing process, including the image to be printed, the location and density of all coatings, and the kinds and amount of treatments to be applied to pad 105. Source 565 preferably is a software program, but can be another computer, a hardware storage device, and the like. Source 565 delivers information to control unit 540.

Further reporting of the position of pad 105 or cylinder 532 preferably is accomplished through indicia such as spots or lines 545 and 550. Indicia 545 and 550 preferably are a detectable modality such as optical marks, but can be magnetic markers, and the like. These indicia are detected by detectors 555 and 560 which can be arranged to detect the presence of indicia 545 and 550, whether they are magnetic or optical. Upon detecting the presence of indicia 545 and 550, detectors 555 and 560 send a signal to control unit 540, optionally causing unit 540 to take a predetermined action, such as the commencement of the printing of an image, and applications of coatings and treatments. Instead of electrical signals for timing, a mechanical arrangement, such as a switch closure, can be used.

OPERATION

Figure 6:
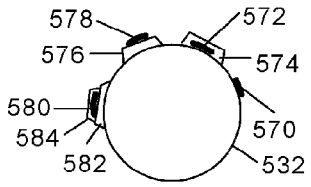
FIG. 6 shows a cross-sectional view of images and coatings applied to a receiving cylinder.

First Embodiment—FIGS. 4-6

FIG. 5 shows the rotary pad printing station in use. An image and one or more optional coating and treatment scenarios has been created in image source 565. Upon receiving the printing information from source 565, control unit 540 awaits a "start" signal from one or both of detectors 555 and 560. Upon receiving this signal, control unit 540 next depends on shaft encoder 535 to know the angular position of pad 105, and by calculation, the angular position of receiving object 532. Encoder 535 preferably is type H3, sold by US Digital, of Vancouver, Wash., USA. This particular encoder is an optical type that delivers as many as 2,500 pulses per revolution of its shaft. Other encoders that have more or fewer pulses per revolution can be used, and use magnetic instead of optical sensing means. Still others report not only incremental rotation, but also give exact angular position.

Unit 540 preferably first activates treatment station 510. Station 510 preferably provides a cleaning operation that removes residual substances from pad 105 prior to application of the next series of substances, but this activity can be omitted in cases where transfer of substances from pad 105 to object 532 is complete. Alternatively, station 510 is a heater which emits infrared radiation onto the surface of pad 105, thereby warming it, or it may be a cooling station that applies a cooling gas to pad 105, thereby cooling it.

After receiving a predetermined number of pulses from encoder 535, unit 540 next activates station 500. This station preferably is a spray head that applies a coating to the surface of pad 105. By counting pulses from encoder 535 and relying on image information from source 565, controller 540 will cause station 500 to be activated and deactivated according to the angular position of pad 105. The coating applied by this station preferably is a varnish overcoat for the final image, but can be a paint or other substance.

After receiving an additional predetermined number of pulses from encoder 535, unit 540 next activates station 505. Station 505 provides any of the aforementioned treatments to the surface of pad 105 and its contents that may previously been applied by station 500. Preferably the treatment is radiation, but can be another such as cooling gases, catalysts, and the like.

After receiving another additional predetermined number of pulses from encoder 535, unit 540 next activates station 400A. This station is uniquely designed to apply an ink image to the surface of pad 105, on top of any previously applied substances. Preferably, this station applies the black content of a color-separated image.

After receiving more pulses from encoder 535, unit 540 next activates station 400B. Station 400B preferably is arranged to apply the cyan component of a color-separated image to the surface of pad 105 and its previously-applied contents, but other colors can be used.

As the rotation of shaft 106 continues, additional pulses cause the activation of station 520. This station is included between ink applications and preferably is used to harden previously-applied layers of ink by applying ultraviolet or infrared radiation to them. Alternatively, station 520 can apply a gas reactant or catalyst to previously applied layers.

After receiving more pulses from encoder 535, unit 540 activates station 400C. Station 400C preferably is arranged to apply the magenta component of a color-separated image, but also can be another color.

After receiving still more pulses from encoder 535, unit 540 activates station 400D. Station 400D preferably is arranged to apply the yellow component of a color-separated image, but also can be another color.

Next, after receiving more pulses from encoder 535, unit 540 activates station 525, causing it to apply any pre-arranged treatment to the surface contents of pad 105. This treatment preferably is ultraviolet radiation, but can be magnetic, heating, cooling, and coating.

After receiving additional pulses from encoder 535, control unit 540 next activates station 527. Station 527 preferably is a spray head for applying an overcoat to the layers previously applied to pad 105, but can also apply a powder layer or other substance.

After receiving still more pulses from encoder 535, control unit 540 next activates station 530. Station 530 preferably is arranged to apply a heating treatment to the previously applied contents on the surface of pad 105, but also can apply any of the other aforementioned types.

Alternatively, instead of activating stations 400 and 500 in response to pulses from encoder 535, control unit 540 can operate on an open-loop basis. Upon receiving a starting signal from one or more of sensors 550 and 560, unit 540 can activate sources 400 and 500 at predetermined intervals determined by the rotational or surface speed of pad 105. Shaft encoder 535 can report the rotational speed of pad 105 to unit 540. Unit 540 can calculate the surface speed of pad 105, if required, based on the radius of pad 105, in well-known fashion.

The individual pixels to be transferred to object 532 can comprise a variety of types. Preferably, as pad 105 rotates in contact with object 532, ink pixel 570 will be transferred to object 532 as-is with no undercoat or overcoat. Ink pixel 572 is accompanied by an overcoat 574. When this pixel combination is transferred to object 532, pixel 572 will be transferred with layer 574 as an undercoat. After transfer, pixel 576 will be accompanied with an overcoat layer 578. After transfer, pixel 580 will be accompanied by an undercoat 584 and an overcoat 582. There are numerous other possibilities.

Although there are four color stations 400A-400D, more or fewer can be used as required by the printing operation at hand. Similarly more or fewer coating and treating stations can be used.

In some cases, receiving cylinder 532 is removed from contact with pad 105 and pad 105 is allowed to rotate two or more times while application of treatments and coatings continues before transfer. After such extra applications, cylinder 532 is again brought into contact with pad 105 for transfer of all layers to cylinder 532.

Each of the stations is activated and deactivated by control unit 540 on a line-by-line basis. Some or all of ink applicators 400A-400D and treatment stations 500-530, are additionally activated on a pixel-by-pixel basis along the active line or lines. All applications are under the control of control unit 540.

One or more of treatment stations, preferably station 530, can apply a catalyst, moisture, heat, cold, or illumination to substances such as ink pixels and coatings 570-584, in order to cause them to cure or partially cure while on pad 105. This can be done to improve transfer to object 532, and to improve image quality by preventing movement of pixels and coatings during transfer.

Instead of using encoder 535, control unit 530 can alternatively supply image and treatment commands at a rate predetermined by an internal clock (not shown).

FIGS. 4 and 6 show the appearance of object 532 after transfer of a complete image.

DESCRIPTION AND OPERATION

Individual Components—FIGS. 4-6

Stations 505, 510, 520, 525, and 530 are treatment stations. Preferably they apply coatings through the use of a spray head or a vapor-deposition applicator. They cause cooling gases to flow against the surface of pad 105 or whatever has been previously deposited thereon. Station 510, in particular, can be a cleaning station that applies anything from a volatile solvent to adhesive tape to the surface of pad 105 in order to clean it in preparation for the next image and coatings transfer. A station can also apply a magnetic field to cause magnetic inks to stand erect from the surface of pad 105. Alternatively, a station can apply an electric field to cause inks to stand erect from the surface of pad 105. Stations can apply radiative energy such as ultraviolet or infrared radiation, or even gamma rays or x-rays. Stations can also optionally apply a flow of gas such as air or an inert or reactive gas to pad 105 and its contents.

Stations 400A-400D preferably are inkjet heads provided with a source of ink, or they can be transfer stations for images printed on an external apparatus such as a xerographic printer, an inkjet printer, or other printing modality.

Figure 7:
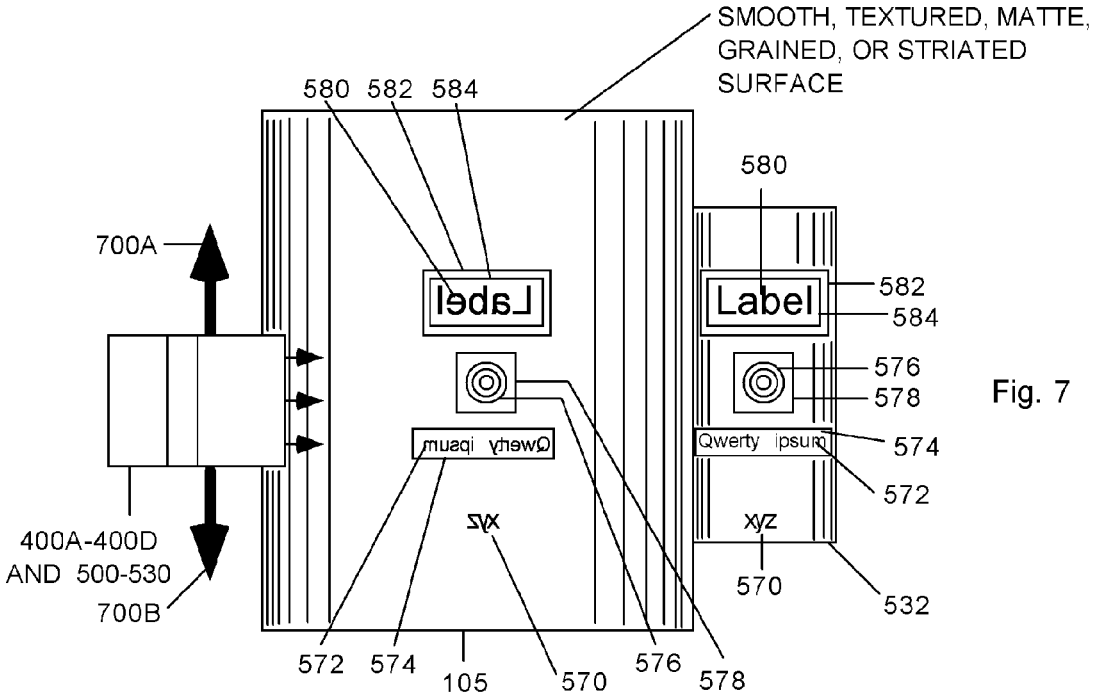
FIG. 7 shows the embodiment of FIGS. 4 and 5 with a traversing head for applying ink images, coatings, and treatments.

Alternative Embodiment—FIG. 7

As shown in FIG. 7, one or more of print heads 400A-400D and stations 500-530 may extend over less than the full axial length of pad 105. In this case, one or more of heads 400A-400D and stations 500-530 can be arranged to traverse part or all of the length of pad 105, as indicated by arrows 700A and 700B.

Figure 8:
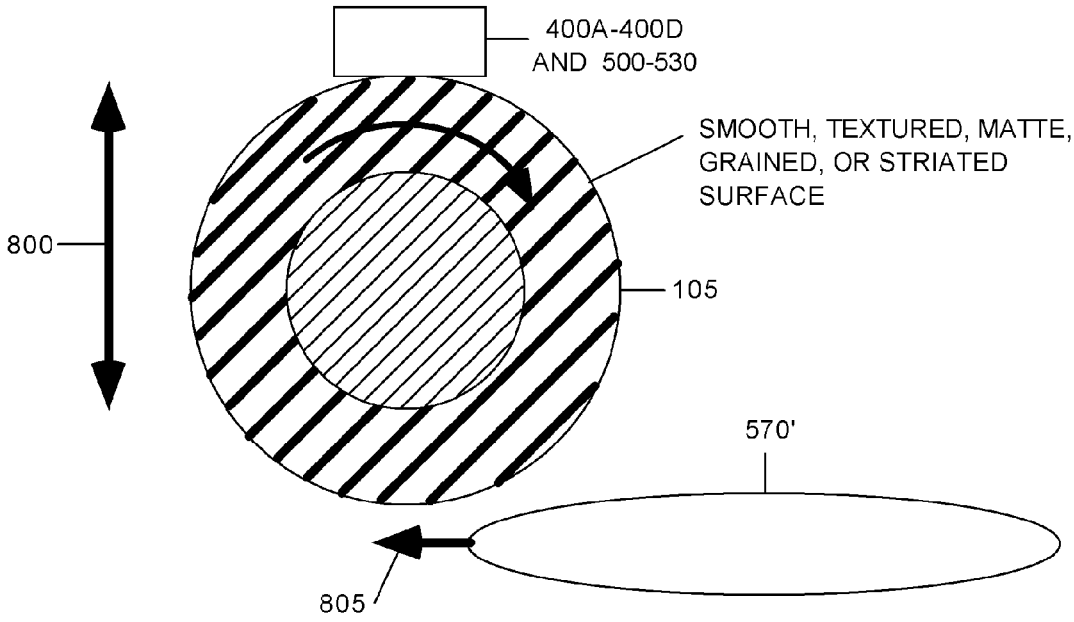
FIG. 8 shows the embodiment of FIG. 4 or FIG. 7 incorporating relative motion between the pad wheel and an object.

Alternative Embodiment—FIG. 8

As shown in FIG. 8, instead of printing on a cylindrical object that rotates, pad 105 and one or more of heads 400A-400D and stations 500-530 can be arranged to move toward or away from the receiving surface. In FIG. 8, pad 105, heads 400A-400D, and stations 500-530 are arranged to move up and down together, in the direction indicated by arrows 800. Object 570' moves from right to left, as indicated by arrow 805. Object 570' moves in synchrony with pad 105 so that there is no slippage between their contacting surfaces as object 570' moves in contact with pad 105. If the two surfaces were allowed to slide past one-another, the image being transferred from pad 105 to object 570' would smear.

Although vertical motion of pad 105 is indicated, any angular motion that provides the proper contact with object 570' can be used.

Instead of pad 105 and one or more of heads and stations 400A-400D and 500-530 moving toward object 532, the heads and stations can remain stationary and object 532 can be brought into contact with pad 105 by raising it, or simply maintaining object 532 at a fixed distance from pad 105 so that it presses against pad 105 as it moves by.

Figure 9:
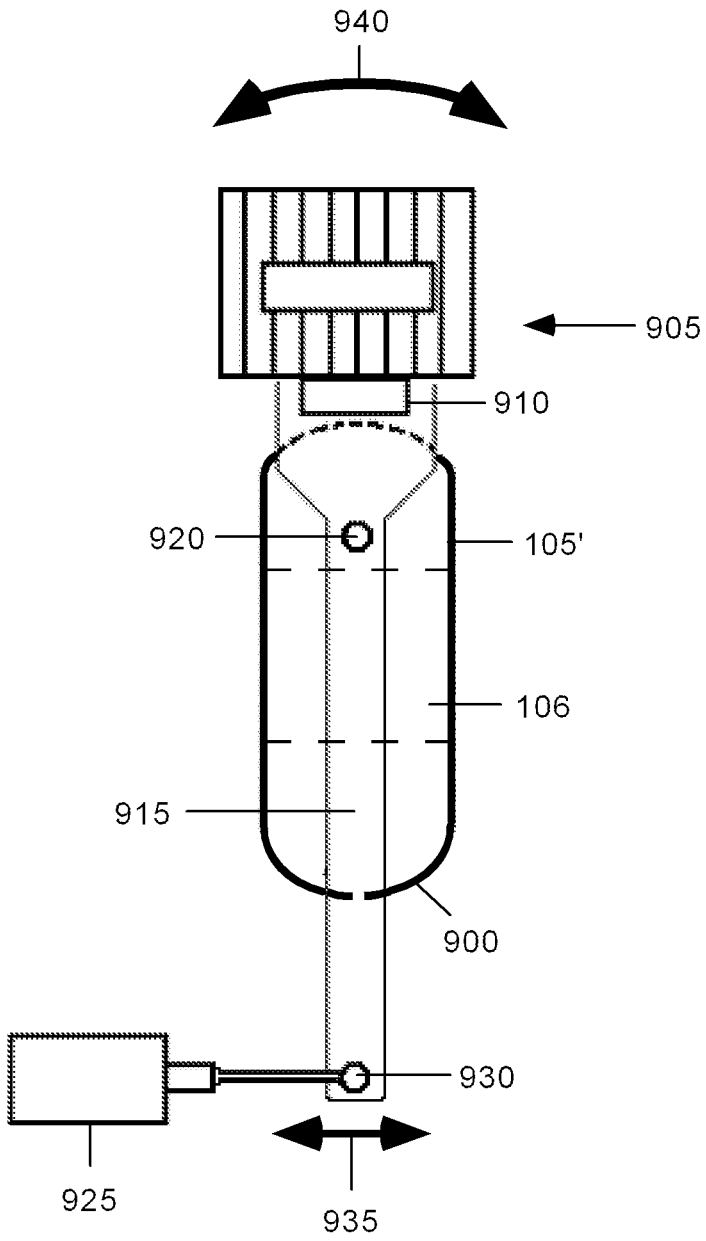
FIG. 9 shows an embodiment with a curved wheel and apparatus for applying inks, coatings, and treatments to the wheel.

Alternative Embodiment—FIG. 9

In the embodiment shown in FIG. 9, pad 105' has a convex, contoured surface 900. Pad 105' rotates on shaft 106, as described above in connection with FIG. 5. An inking assembly 905 is arranged to apply an ink image to pad 105' as pad 105' rotates. Assembly 905 includes an applicator head 910, such as but not limited to an inkjet head. Head 910 preferably also incorporates treatment and coating stations such as 500-530, described above.

In many cases, head 910 must operate at a nearly constant distance from surface 900 of pad 105'. This is accomplished in this embodiment by a lever arm 915, a pivot 920, and a servomechanism 925. Assembly 905 is attached to one end of arm 915. At the other end of arm 915, a clevis 930 attaches arm 915 to a servomechanism 925.

Servomechanism 925, head assembly 905, and head 910 are all under the control of a control unit (not shown in this figure), as described above in connection with FIG. 5. As pad 105' rotates, servomechanism 925 moves clevis 930 in a left-right motion, as indicated by arrows 935. This motion translates to rotational motion of head assembly 905, as indicated by arrows 940. The location of pivot 920 is chosen so that head 910 remains at a constant, predetermined distance from surface 900 of pad 105'. Pad 105' may execute more than one revolution, if required, prior to being brought into contact with a receiving surface (not shown in this figure) for transfer of the ink image.

Instead of moving head 910 in an arc around the surface of pad 105', the axis of pad 105' can be made to oscillate in an equivalent way so that head 910 remains at a fixed distance from the surface of pad 105'.

Alternative Embodiments—FIGS. 10-15

FIGS. 10-15 show an alternative embodiment using a belt for transfer, instead of the surface of a wheel. Instead of being formed on and primarily supported by a central core or shaft 106 (FIG. 5), the pad comprising belt 1000 is supported primarily by two shafts 1001 and 1002. Pad belt 1000 is free to rotate around shafts 1001 and 1002. This system comprises a control unit (not shown), heads 400A-400D, stations 500-530, two wheels, pulleys, or rollers 1001 and 1002, an object to be printed 1005, an optional ram 1010, and optional rollers 1100 and 1105.

Belt 1000 is made of a flexible silicone rubber or other material suitable for use in pad printing. It may be strengthened by an internal webbing made of cotton, plastic, or metal (not shown). In its thick aspect (FIGS. 10-12), belt 1000 preferably is 1 cm thick, but can be thicker or thinner. In its thin aspect (FIGS. 13-15), belt 1000 is approximately 1 mm thick, although other thicknesses can be used. Belt 1000 preferably is 15 cm wide, but can range from 0.5 to 25 cm in width, although even wider widths can be used.

Belt 1000 is driven by one or both of wheels 1001 and 1002. The lengths of pulleys 1001 and 1002 are greater than or equal to the width of belt 1000. One or both of pulleys 1001 and 1002 can be crown rollers in order to cause belt 1000 to remain centered on the pulleys, in well-known fashion to those skilled in the design of moving belts.

Instead of heads 400A-400D and stations 500-530 being located at the top of belts 1000, some or all of them can be located at the circumference of belt 1000 on wheel 1001 or 1002, as shown in FIG. 5.

With reference to FIGS. 10-15, belt 1000 traverses beneath heads 400A-400D and stations 500-530, collecting depositions and treatments of inks and coatings in preparation for transfer to object 1005, as described above in connection with FIG. 5.

Figure 10:
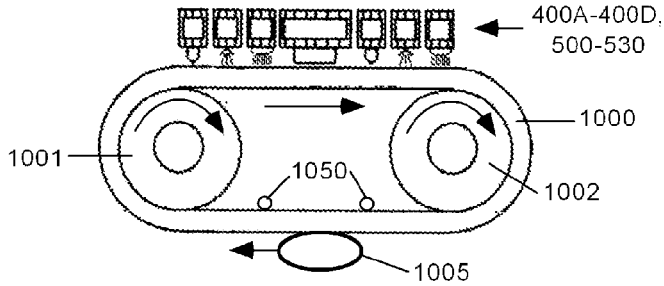
FIGS. 10-15 show embodiments incorporating a belt in place of a wheel surface.
Figure 11:
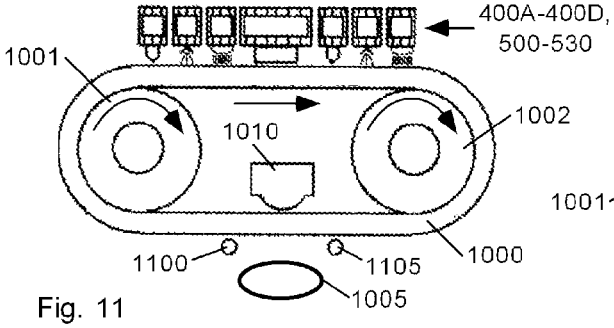
Figure 12:
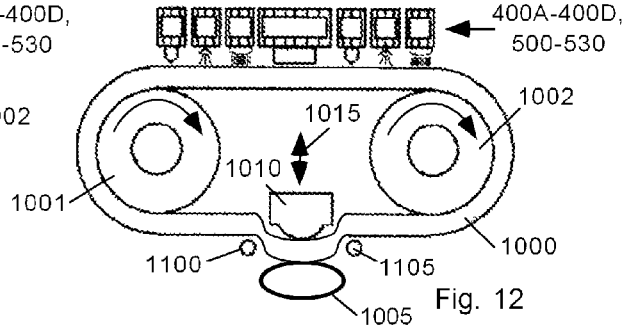
Figure 13:
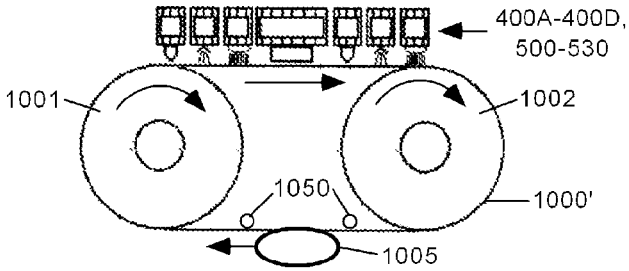
Figure 14:
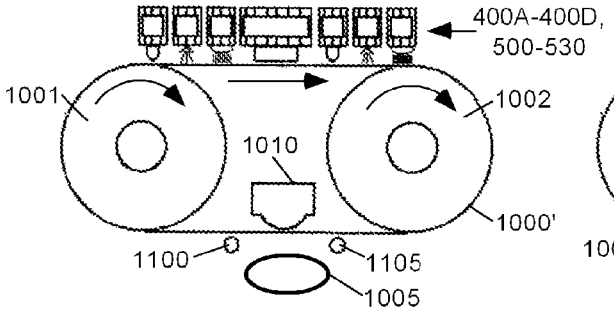
Figure 15:
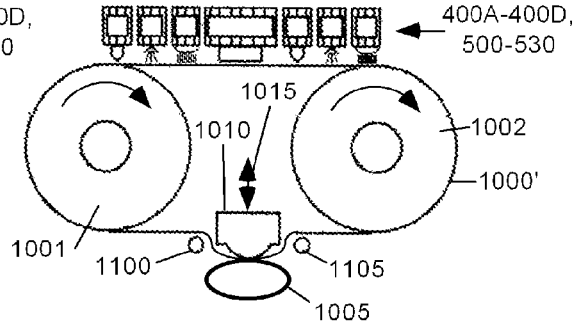

In FIGS. 10 and 13, transfer of the ink image (not shown) is made to object 1005 by simple contact with belt 1000. Object 1005 is caused to move from right to left with the speed of belt 1000 in order to prevent smearing of the ink image on object 1005. Optional rollers 1050 prevent the displacement of belt 1000 by object 1005 and improve contact between the two during transfer of the ink image.

In FIGS. 11-12, and 14-15, a ram 1010 moves up and down as indicated by arrows 1015 in order to transfer the previously deposited ink image from belt 1000 to object 1005. Belt 1000 is normally stopped during operation of ram 1010.

In FIGS. 10-15, the motion of belt 1000 can be continuous or intermittent, depending upon the requirements of the individual printing job.

Treatment Stations—FIGS. 16-21

Treatment stations 500-530 preferably apply radiative emissions, but can comprise at least one of the following capabilities: radiative emission such as infrared, visible, and ultraviolet light, x-rays, radio waves, microwaves, plasma, and gamma rays; vapor emission, such as steam, hot air, chemical vapors such as solvent vapors or catalysts, and the like; spray emission such as coatings, adhesives, catalysts, and the like; flame emission; and other modalities such as infrasound (very low frequencies), audible sound, and ultrasound (very high frequencies).

Figure 16:
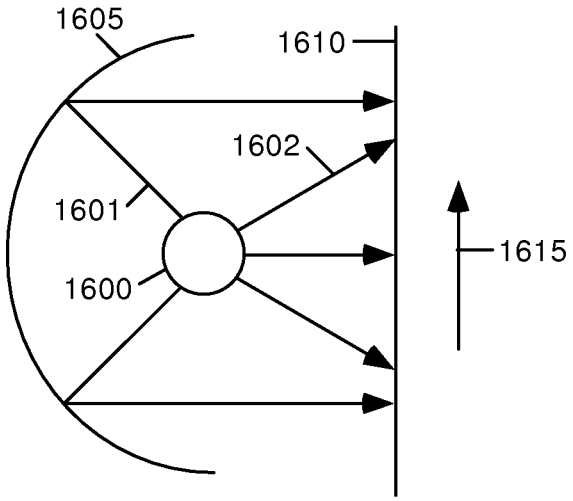
FIGS. 16-21 show details of stations for applying coatings and treatments to a wheel or belt.

An exemplary radiative emission station is shown in FIG. 16. A source 1600 radiates emissions 1601 and 1602 in a plurality of directions. A wheel or belt surface 1610 receives the emissions. Although surface 1610 is depicted as flat, it can be curved or irregular. Emissions 1601 strike and are reflected by an optional reflector 1605, preferably a parabolic reflector, although other shapes can be used. Emissions 1602 impinge directly onto surface 1610. The emissions of source 1600 are delivered to surface 1610 and the substances thereon (inks, coatings, and the like) and preferably cause them to harden, but alternatively can cause them to soften, melt, evaporate, change color, or otherwise change its composition, appearance, or structure. Arrow 1615 indicates optional relative motion between surface 1610 and source 1600.

Source 1610 preferably is an ultraviolet lamp, but alternatively can comprise one or more light-emitting diodes (LED), gas-discharge lamps, heating coils, x-ray source, microwave source, gamma ray source, sound source, and the like.

Figure 17:
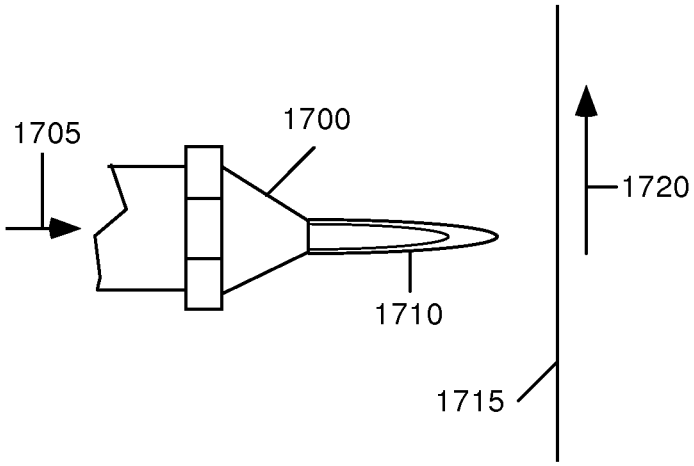

An preferred flame source for treating substances applied to the surface of an object 1715 is shown in FIG. 17. A torch tip 1700 is supplied with gas indicated by arrow 1705 from a source (not shown). Gas 1705 preferably is a single or multi-component combustible agent. Gas 1705 is ignited to form a flame 1710. Flame 1710 either contacts or comes into proximity with surface 1715. The heat, and in some cases the chemical composition within flame 1710, cause a change in the substances borne on surface 1715, and surface 1715 itself, if desired. Arrow 1720 indicates optional relative motion between surface 1715 and flame 1710.

Figure 18:
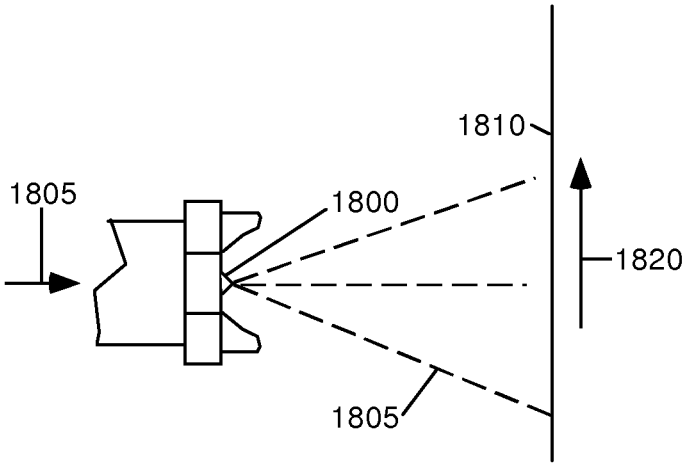

FIG. 18 shows a spray source with a nozzle 1800 and a source 1805 of material to be sprayed. An ink image and one or more optional coatings have been or may soon be applied to a surface 1810. Material 1805 is emitted as a spray of fine droplets or vapor by nozzle 1800. Droplets or vapor 1805 apply a coating or vapor treatment to surface 1810 and any substances thereon or about to be applied thereon. Material 1805 can also be a release agent to facilitate release of all subsequently-applied layers from surface 1810 to the surface of the receiving object (not shown).

Figure 19:
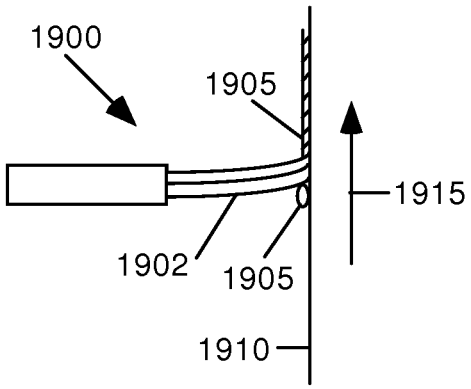

FIG. 19 shows a brush applicator 1900 with bristles 1902 applying a substance 1905 to belt or wheel surface 1910. Surface 1910 moves with respect to brush 1900 as indicated by arrow 1915. Bristles 1902 preferably are bristle, but alternatively can be any suitable material, including a plastic, animal hair, or plant fibers. In another aspect, brush 1900' can be an anti-static brush. In this case, a large number of metal wires replace the bristles. These wires can either touch surface 1910, or be placed very near to it. In either case, if the bristles and surface 1910 are held at the same potential, all static electricity will be discharged from surface 1910 in well-known fashion.

Figure 20:
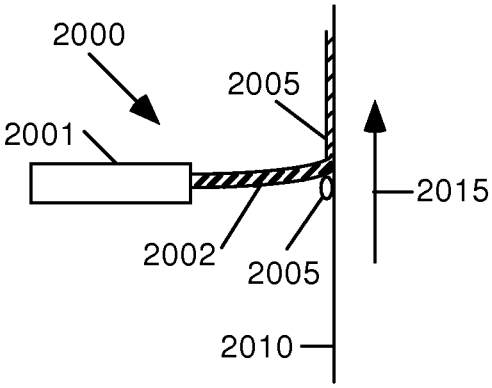

FIG. 20 shows the use of a doctor blade to meter a substance onto the surface of a receiving object. A doctor blade assembly 2000 comprises a clamp 2001 and a blade 2002. Blade 2002 is typically made of a flexible urethane rubber of durometer (Shore) hardness value between 5 and 85. A coating material 2005 is supplied to the lower side of blade 2002 from a source (not shown). Material 2005 is smoothed out into a layer as object 2010 moves with respect to blade 2002. The direction of motion is indicated by arrow 2015.

Figure 21:
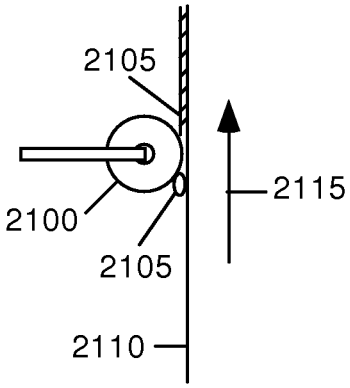

FIG. 21 shows the use of an applicator roller to apply a substance to the surface of a receiving object. A roller 2100 is held in contact with receiving surface 2110 and any other substances which have been applied to surface 2110. Surface 2110 moves with respect to roller 2100, as indicated by arrow 2115. A source (not shown) supplies coating material 2105 to the lower side of roller 2100. As surface 2110 moves with respect to roller 2100, a uniform thickness of material 2105 is deposited on surface 2110. Roller 2100 preferably is a silicone rubber with durometer hardness values between 5 and 85.

The treatments shown in FIGS. 16-21 preferably are applied to the belt or wheel surfaces individually, but can be applied simultaneously or serially.

Alternative Embodiments—Segmented Pads—FIGS. 22-26

Figure 22:
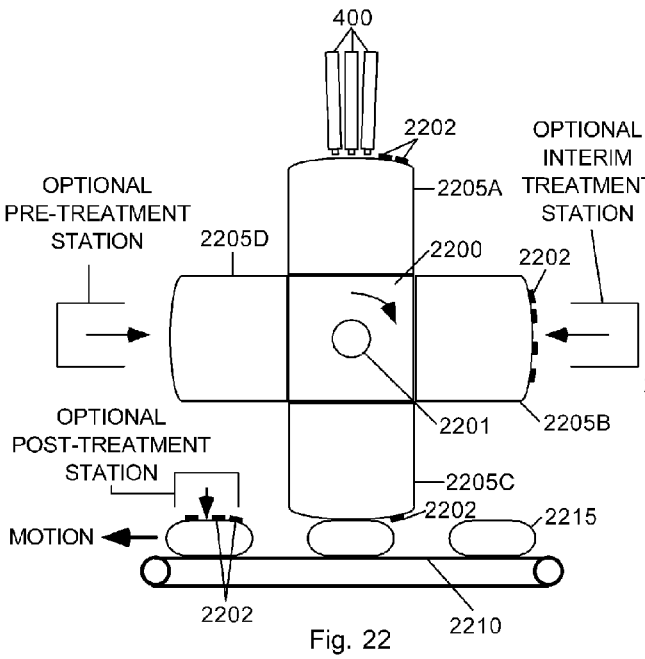
FIGS. 22-26 show additional embodiments using individual pads in a rotary apparatus.
Figure 23:
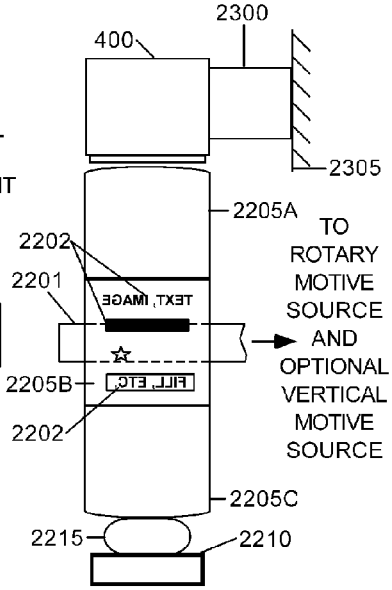

FIGS. 22-26 show an aspect of the previous embodiments that employs segmented, revolving pads, with individual circularly arcuate surfaces replacing portions of a roller, as shown instead of continuous rollers or belts. In FIGS. 22 and 23, a rotor 2200 is mounted on a shaft 2201. One or more pads 2205 are affixed to rotor 2200. Ink applicators 400 are fixed in space by a bracket 2300 (FIG. 23) secured to a datum 2305, and are positioned above pad 2205A. In response to signals from a control unit (not shown) applicators 400 apply an ink image 2202 to each of pads 2205 as shaft 2201 rotates in a continuous fashion, moving pads 2205 sequentially beneath them. As in the previous embodiments, a series of treatment stations are positioned to apply pre-treatments, interim treatments, and post-treatments to pads 2205 and substances that have been deposited thereon. Pre-treatment can include cleaning pad 2205 in preparation for its next use.

A conveyor 2210 moves in synchronism with pads 2205 as shaft 2201 rotates. Conveyor 2210 is positioned so that objects 2215 will come into contact with pads 2205 as they move from right to left. As objects 2215 come into contact with pads 2205, image 2202 is transferred from pads 2205 to objects 2215. An optional post-treatment step, preferably an overcoat, but alternatively UV exposure, etc. completes printing of objects 2215.

Figure 24:
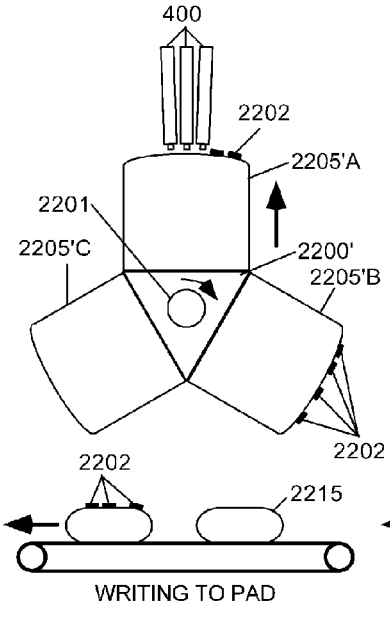
Figure 25:
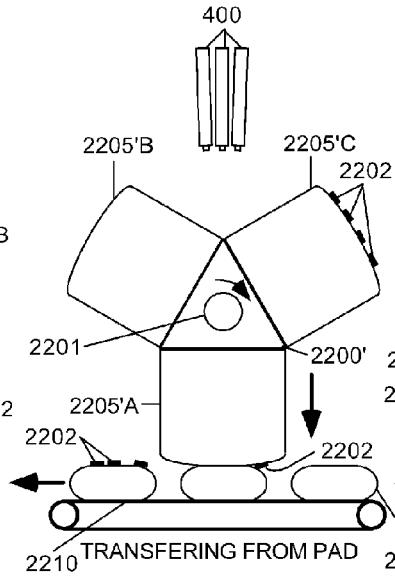
Figure 26:
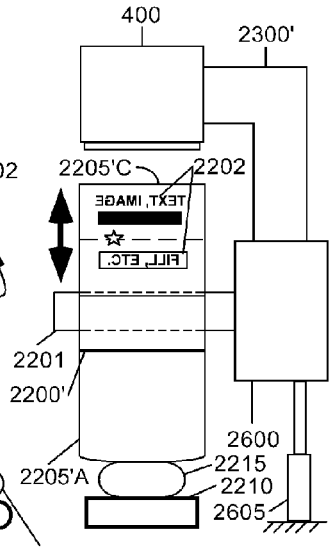

FIGS. 24 through 26 show another aspect of the above embodiment. FIGS. 24 and 25 show front views of a printing assembly according to this aspect at two different times. FIG. 26 shows a side view of the printing assembly at the same time as in FIG. 25. A rotary motive source (FIG. 26) 2600 causes shaft 2201 to rotate under the control of a control unit (not shown). A vertical motive force actuator 2605, preferably a hydraulic or pneumatic ram actuator, causes motive source 2600, bracket 2300', applicators 400, and shaft 2201 to move vertically, again under control of a control unit (not shown).

FIG. 24 shows a pad 2205'A in a position to receive an ink image 2202 as it rotates beneath image applicators 400. As shaft 2201 rotates, the top surface of pad 2205', mounted on rotor 2200', passes beneath applicators 400 and receives an ink image 2202. Shaft 2201continues to rotate until one of pads 2205', containing an ink image 2202, is positioned above a receiving object 2215. Instead of rotating continuously, shaft 2201 rotates intermittently. When pad 2205' is located above an object 2215, the controller causes shaft 2201 to stop rotating. Next, actuator 2605 (FIG. 26) lowers rotor 2200' and pad 2205' so that pad 2205' comes into contact with object 2215 directly beneath in a stamping action, thereby transferring ink image 2202 to object 2215. In this embodiment, conveyor 2210 moves in a start-stop fashion. Each object 2215 to be printed is moved to a position beneath shaft 2201 and one of pads 2205' and then held at that position while ink image 2202 is transferred from pad 2205' to object 2215 with a stamping motion.

Although objects 2215 are shown moving on conveyor 2210, they can instead be held in place beneath shaft 2201 and one of pads 2205' when pad 2205' is oriented as shown in FIG. 25. Although three or four pads are shown, more or fewer pads can be used. Pads 2205 can be of a custom design, or they can be standard pads available for use in prior-art, non-rotary, pad printing systems. Instead of raising and lowering source 2600, bracket 2300' and sources 400, actuator 2605 can raise and lower conveyor 2210 or individual objects 2215 to effect transfer of image portions 2202 to objects 2215 through a stamping action.

CONCLUSIONS, RAMIFICATIONS, AND SCOPE

The embodiments shown of our improved pad printing method and apparatus incorporate an inking station and a flexible, moving surface. An inking head, such as an inkjet, applies an ink image to the moving surface. The ink image on the surface is further optionally treated by one or more stations comprising emissive and radiative sources, spray sources, vapor sources, and the like. These sources provide overcoats, undercoats, additional chemical reactants and catalysts, additional ink colors, heat, infrared, visible, and ultraviolet light, and flames.

While the above description contains many specificities, these should not be considered limiting but merely exemplary. Many variations and ramifications are possible. While preferred materials, sizes, treatments, and the like have been indicated, these are merely the currently preferred parameters for one or more applications and obviously will change for other applications and at other times. For example, pads may be soft or firm and may be made of a variety of materials such as plastics, silicone rubbers, gelatin, caoutchouc, and the like. Many or few treatment stations and ink sources can be used.

Inkjet heads must typically be kept a distance of about one millimeter from the surface that receives the ink. A positioning servomechanism with sensors that sense the distance between the inkjet head and the pad surface can be used to maintain the proper distance between the inkjet head and the pad surface as the pad rotates.

While the present system employs elements which are well known to those skilled in the art of pad printing, it combines these elements in a novel way which produces one or more new results not heretofore discovered. Accordingly the scope of this invention should be determined, not by the embodiments illustrated, but by the appended claims and their legal equivalents.

The invention claimed is:

1. A pad printing system for printing onto a receiving surface, comprising:

(a) a rotatable shaft having an axis, (b) a plurality of resilient pads secured to said rotatable shaft, each of said plurality of resilient pads having an arcuate ink-receiving-and-releasing surface, said arcuate ink-receiving-and-releasing surface having an axis that is coaxial with said axis of said rotatable shaft, (c) a first motive source for rotating said shaft, (d) an ink source containing ink of at least one color, (e) an image source that supplies at least one reverse-reading image, (f) at least one ink-applicator means extending parallel to said axis of said shaft and spaced a predetermined distance from said axis of said shaft, said applicator means being connected to said image source and supplied with said ink from said ink source and arranged to print said reverse-reading image with said ink directly and without use of an intermediate release surface onto said surface of at least one of said pads while said shaft rotates, (g) a second motive source arranged to urge said receiving surface and said surface of said at least one of said pads into stamping contact at a predetermined time, (h) a control unit where said control unit causes:

(1) said first motive source to cause said shaft to rotate, (2) said ink applicator means to print said reverse-reading ink image directly onto said surface of said one pad while said pad rotates beneath said ink-applicator means, (3) said first motive source to rotate said one pad over said receiving surface and stop with said one pad positioned over said receiving surface, and (4) at said predetermined time, said second motive source to urge said one pad into stamping contact with said receiving surface while said first motive source is stopped so that said reverse-reading ink image is transferred by stamping onto said receiving surface as a right-reading ink image, whereby said reverse-reading ink image is printed with said ink onto said one of said pads while said one of said pads rotates, and then rotation of said one of said pads is stopped and said one of said pads is urged into stamping contact with said receiving surface while said one of said pads is stopped in order to transfer said reverse-reading ink image from said one of said pads onto said receiving surface as said right-reading ink image, thereby printing said right-reading ink image onto said receiving surface while improving reliability by requiring few parts and eliminating degradation of said right-reading ink image by using only a single transfer of said ink from said pad to said receiving surface.

2. The system of claim 1, wherein said ink is selected from the group consisting of frit, particle, metallic, magnetic, dye, pigment-containing, ultraviolet-curable, infrared-curable, light-curable, heat-curable, cold-curable, catalyst-curable, microwave-curable, water-based, wax-based, solvent-based, oil-based, and multi-component and evaporating inks.

3. The system of claim 1, wherein said ink applicator is selected from the group consisting of offset, dye transfer, wax transfer, inkjet, spray, and electrostatic applicators.

4. The system of claim 1, wherein said pads comprise a material selected from the group consisting of gelatin, caoutchouc, latex rubber, synthetic rubber, silicone rubber, and plastic materials.

5. The system of claim 1 wherein said surface of said pad is selected from the group consisting of smooth and textured surfaces.

6. The system of claim 1, wherein said first and said second motive sources are selected from the group consisting of electrical, pneumatic, magnetic, and hydraulic sources.

7. The system of claim 1, wherein said ink can be cured by a treatment selected from the group consisting of liquid sprays, powder sprays, vapors, sonic energy, heat, light including ultraviolet light, x-rays, gamma rays, magnetic fields, electrostatic fields, and plasma discharges.

8. The system of claim 1, further including at least one treatment applicator responsive to said commands issued by said control unit and capable of applying at least one treatment selected from the group consisting of liquid spray, powder spray, vapor, sonic energy, heat, light including ultraviolet light, x-ray, gamma ray, magnetic field, electrostatic field, and plasma discharge applicators.

9. The system of claim 1, wherein the material comprising said pad is selected from the group consisting of insulative and conductive materials.

10. The system of claim 1, further including at least one source of electrical potential connected between said pad and said ink applicator means.

11. A method for pad printing an image onto a receiving surface, comprising:

(a) providing a rotatable shaft having an axis, (b) providing a plurality of resilient pads secured to said rotatable shaft, each of said plurality of resilient pads having an arcuate ink-receiving-and-releasing surface, said arcuate ink-receiving-and-releasing surface having an axis that is coaxial with said axis of said rotatable shaft, (c) providing a first motive source for rotating said shaft, (d) providing an ink source containing ink of at least one color, (e) providing an image source that supplies at least one reverse-reading image, (f) providing at least one ink-applicator means extending parallel to said axis of said shaft and spaced a predetermined distance from said axis of said shaft, said applicator means being connected to said image source and supplied with said ink from said ink source and arranged to print said reverse-reading image with said ink directly onto said surface of at least one of said pads while said shaft rotates and without use of an intermediate release surface, (g) providing a second motive source arranged to urge said receiving surface and said surface of said at least one of said pads into stamping contact at a predetermined time, (h) providing a control unit where said control unit causes:

(1) said first motive source to cause said shaft to rotate, (2) said ink applicator means to print said reverse-reading ink image directly onto said surface of said one pad while said pad rotates beneath said ink-applicator means, (3) said first motive source to rotate said one pad over said receiving surface and stop with said one pad positioned over said receiving surface, and (4) at said predetermined time, said second motive source to urge said one pad into stamping contact with said receiving surface while said first motive source is stopped so that said reverse-reading ink image is transferred by stamping onto said receiving surface as a right-reading ink image, whereby said reverse-reading ink image is printed with said ink onto said one of said pads while said one of said pads rotates, and then rotation of said one of said pads is stopped and said one of said pads is urged into stamping contact with said receiving surface while said one of said pads is stopped in order to transfer said reverse-reading ink image from said one of said pads onto said receiving surface as said right-reading ink image, thereby printing said right-reading ink image onto said receiving surface while improving reliability by requiring few parts and eliminating degradation of said right-reading ink image by using only a single transfer of said ink from said pad to said receiving surface.

12. The method of claim 11, wherein said first and said second motive sources are selected from the group consisting of electrical, pneumatic, magnetic, and hydraulic sources.

13. The method of claim 11 wherein said ink is selected from the group consisting of water based, wax-based, solvent-based, oil-based, and multi-component inks and coating materials.

14. The method of claim 11, wherein said ink applicator is selected from the group consisting of offset, dye transfer, wax transfer, inkjet, spray, and electrostatic applicators.

15. The method of claim 11, wherein said pads comprise materials selected from the group consisting of gelatin, caoutchouc, latex rubber, synthetic rubber, silicone rubber, and plastic materials.

16. The method of claim 11, wherein said surface of said pads is selected from the group consisting of smooth and textured surfaces.

17. The method of claim 11 wherein the material comprising said pad is selected from the group consisting of insulative and conductive materials.

18. The method of claim 11, further including at least one source of electrical potential connected between said at least one of said pads and said ink applicator.

19. The method of claim 11, further including a plurality of said ink applicators.

20. The method of claim 11, further including at least one ink applicator arranged to apply at least one treatment to said pad, said treatment selected from the group consisting of liquid sprays, powder sprays, vapors, sonic energy, heat, light including ultraviolet light, x-rays, gamma rays, magnetic fields, electrostatic fields, and plasma discharges in response to said commands issued by said control unit.

21. The method of claim 11, wherein said receiving surface is selected from the group consisting of flat, curved, and irregular surfaces.

22. A pad printing system for printing a right-reading ink image onto a receiving surface, comprising:

(a) a plurality of non-contiguous, resilient pads, each pad having a circularly arcuate surface having an axis of curvature and arranged to directly receive and temporarily retain a reverse-reading copy of said ink image, each of said pads rigidly secured to a rotatable shaft having the same axis as said pads, (b) a control unit for issuing commands for operation of said system, (c) an actuable first motive source for rotating said shaft, (d) a second motive source for urging said surface of at least one of said plurality of resilient pads into stamping contact with said receiving surface while said first motive source is inactivated, (e) an image source containing at least one original image that has been separated into a plurality of reverse-reading images comprising a plurality of respective color components of said original image, (f) said first and said second motive sources and said image source being responsive to commands from said control unit, (g) a plurality of ink applicators, each of said ink applicators being connected to an ink source, each of said ink sources being arranged to supply ink of the same color as said respective color components of said original right-reading image, each of said ink applicators being an equal distance from said shaft, (h) each of said ink applicators being responsive to said commands from said control unit for applying said color component portion of said original image directly, without use of an intermediate release surface, from said ink applicator onto said surface of said pad in registration with said original image while said first motive source is actuated and said shaft rotates, whereby, when urged by said commands from said control unit, said color components of said image are applied as said reverse-reading images to said pad while said pad rotates, and then said pad is stopped and urged into stamping contact with said receiving surface, thereby simultaneously transferring all of said color components of said image in registration as a right-reading image onto said receiving surface at the same time while obviating the need for an intermediate release surface.

23. The system of claim 22, wherein said ink applicator means are selected from the group consisting of offset, dye transfer, wax transfer, inkjet, spray, and electrostatic applicators.

24. The system of claim 22, further including at least one treatment applicator responsive to said commands issued by said control unit and capable of applying at least one treatment selected from the group consisting of liquid spray, powder spray, vapor, sonic energy, heat, light including ultraviolet light, x-ray, gamma ray, magnetic field, electrostatic field, and plasma discharge applicators.

25. The system of claim 22, wherein at least one of said inks can be cured by a treatment selected from the group consisting of liquid sprays, powder sprays, vapors, sonic energy, heat, light including ultraviolet light, x-rays, gamma rays, magnetic fields, electrostatic fields, and plasma discharges.

* * * * *